United States Patent [19]

Galis

[11] 3,951,215

[45] Apr. 20, 1976

[54] MOBILE DRILLING AND BOLTING MACHINE

[76] Inventor: Alex J. Galis, 507 Woodland Drive, Morgantown, W. Va. 26505

[22] Filed: Nov. 22, 1974

[21] Appl. No.: 526,218

[52] U.S. Cl. ..... 173/23; 173/52; 299/10

[51] Int. Cl.[2] ..... E21C 11/02; E21C 27/22

[58] Field of Search ..... 173/23, 28, 52; 299/10, 299/31

[56] References Cited

UNITED STATES PATENTS

| | | | |
|---|---|---|---|
| 3,375,880 | 4/1968 | Pyles et al. | 173/52 |
| 3,768,574 | 10/1973 | Long | 173/23 |
| 3,834,761 | 9/1974 | Ray et al. | 173/23 |
| 3,842,610 | 10/1974 | Willis et al. | 173/52 |

*Primary Examiner*—James A. Leppink
*Attorney, Agent, or Firm*—Stanley J. Price, Jr.

[57] ABSTRACT

Apparatus for drilling holes and installing roof bolts therein for the support of a mine roof includes a prime mover operably connected to a mobile body portion having a pair of spaced apart individually operated drill units. Each drill unit is movably supported on a horizontal frame portion of the mobile body portion by a carriage. The carriage is reciprocally mounted on a plurality of parallel spaced transversely extending beam members that are rigidly secured to the horizontal frame portion. A fluid actuated piston cylinder assembly connected to the carriage is operable to transversely move the carriage with the drill unit along a path transverse to the longitudinal axis of the mobile body portion for drilling holes at preselected spaced intervals in the mine roof. The movement of the carriage is remotely controlled from an operator's station that is protected by an overhead canopy. After drilling a transverse row of bolt holes and installing roof bolts therein, a telescoping mechanism connected to the body portion is forwardly extended a preselected distance and parallel to the longitudinal axis of the mobile body portion. Roof and ground engaging jacks positioned on the end portion of the telescoping mechanism are actuated to rigidly brace the telescoping mechanism. The telescoping mechanism is retracted and the entire mobile drilling machine is forwardly advanced a preselected distance for positioning the drill units to drill a subsequent transverse row of bolt holes parallel to and spaced from the previous row of drilled holes. Fluid activated roof support and ground engaging jacks are also provided on the mobile body portion to support the mine roof and brace the machine during the drilling and bolting operations.

10 Claims, 2 Drawing Figures

MOBILE DRILLING AND BOLTING MACHINE

BACKGROUND OF THE INVENTION

1. Field of the Invention

This invention relates to a mobile drilling and bolting machine and more particularly to a drilling and bolting assembly mounted for transverse and longitudinal movement on a frame portion for precisely positioning the assembly to drill bolt holes and install roof bolts at preselected locations in a mine roof.

2. Description of the Prior Art

In underground mining, it is the conventional practice to support the mine roof by bolts that extend into predrilled holes in the mine roof and to secure bearing plates or horizontal timbers in abutting relation with the roof surface. The holes are drilled in rows that extend transversely and longitudinally of the entry in a selected pattern with the holes spaced at given intervals. Conventional, modern drilling machines such as disclosed in U.S. Pat. No. 3,252,525 and 3,375,880 teach progressively moving a drilling machine mounted on a mobile body portion through the mine and drilling bolt holes in the roof according to a standard bolt pattern. The drilling machine is carried on the end of a boom member which is raised and lowered in a linear vertical path to permit vertical drilling of bolt holes in the roof. In addition, the boom through a horizontal linkage mechanism is operable to position the drill unit for drilling holes in the roof along a straight line transverse to the longitudinal axis of the drilling machine and across the entry. By selectively moving the boom, the bolt holes may be spaced at preselected intervals to provide the optimum roof support. When a transverse row of holes has been drilled, the operator either advances the drilling unit forwardly in a path parallel to the longitudinal axis of the drilling machine or forwardly advances the entire mobile machine a given distance ahead to drill a subsequent transverse row of holes.

Considerable effort and skill is required on the part of the machine operator to locate the drill for drilling holes in the mine roof that conform to a selected pattern. Not only must the operator be concerned with maintaining the correct spacing between adjacent holes in the transverse row, but also with maintaining proper spacing between adjacent longitudinal rows whereby the holes are spaced both transversely and longitudinally at given intervals according to the selected pattern. Subsequently, considerable delay is encountered in locating the holes for drilling, especially if the longitudinal spacings between transverse rows is accomplished by forward tramming of the drilling machine. Because the roof drilling and bolt installation operation is the slowest operation in the mining cycle, it is essential these operations be conducted without unnecessary delays in locating and drilling the bolt holes.

The conventionally known roof bolting machines require that the operator work under exposed portions of the mine roof, subjecting the operator to the hazard of rock material dislodging from the roof during the drilling and bolting operations. To reduce the hazard, temporary roof jacks, which are manually set in placed by the operator, have been utilized to support the section of roof into which the holes are to be drilled. However, considerable time is involved engaging and disengaging the temporary jacks resulting in additional delay of the mining cycle.

There is a need for a mobile drilling and bolting machine that drills bolt holes and installs roof bolts in the roof of an underground mine in which the roof drill is selectively moved to drill holes in the mine roof in transverse and longitudinal rows at spaced intervals with the operator protected at all times from the hazard of roof falls.

SUMMARY OF THE INVENTION

In accordance with the present invention, there is provided a mobile drilling and bolting machine that includes a mobile body portion having a horizontal frame portion. A propelling device is pivotally connected to the mobile body portion and is operable to move the mobile body portion to selected locations in a mine. An extensible mechanism is provided on the horizontal frame portion for forwardly advancing the frame portion a preselected distance. A drilling assembly is movably positioned on the horizontal frame portion. The horizontal frame portion includes a guide mechanism that is movably positioned thereon and supports the drilling assembly for transverse movement to a preselected location on the horizontal frame portion. An actuating device is connected to the guide mechanism and the horizontal frame portion and is operable to move the guide mechanism together with the drilling assembly to a preselected position on the horizontal frame portion.

The drilling assembly includes a pair of drill pods that are positioned in spaced relationship on the guide mechanism and are operably movable by the guide mechanism for drilling holes in the mine roof along a line transverse to the longitudinal axis of the mobile body portion. Each drill pod comprises a drilling unit which is carried on the end of a vertically movable boom member. The boom member is raised and lowered by an elevating link. The raising and lowering of the boom and movement of the drill pods on the guide mechanism is remotely controlled by actuating valve devices positioned on a control panel provided at an operator's station. The operator's station is protected by an overhead canopy that is movable with the drilling assembly to provide the operator with overhead protection at all times during the drilling and bolting operations.

The guide mechanism includes a plurality of parallel spaced transversely extending beam members which are rigidly mounted on the surface of the horizontal frame portion. A carriage is mounted for sliding reciprocal movement on the beam members and supports the drilling assembly. With this arrangement the drilling assembly by operation of a fluid actuated piston cylinder assembly connecting the carriage with the transverse beam members is moved transversely on the horizontal frame portion to thus laterally position the drill pods for drilling holes at preselected locations in the mine roof along a line transverse to the longitudinal axis of the mobile body portion.

The drilling assembly is longitudinally movable along a line parallel to the longitudinal axis of the mobile body portion by operation of the extensible mechanism. The extensible mechanism includes a first telescoping member secured to the mobile boby portion and a second telescoping member reciprocally movable on the first telescoping member. To forwardly advance the drilling assembly, the second telescoping member is forwardly extended relative to the first telescoping member. Roof and ground engaging jack members are activated to rigidly secure the end portion of the second telescoping member. With the second telescoping member rigidly secured, the first telescoping member is retracted into the second telescoping member, thereby imparting a forward force upon the mobile body portion and the prime mover. The mobile drilling machine is thus moved a preselected distance forward of its previous position for drilling a second row of transverse bolt holes parallel to and spaced from the previous row of drilling bolt holes without requiring forward tramming of the drilling machine. In addition, fluid actuated jack members are provided on the mobile body portion and the drilling assembly for engagement with the mine roof and floor to thereby rigidly secure the mobile drilling machine and support the mine roof during the drilling and bolting operations.

Accordingly, thee principal object of the present invention is to provide a mobile drilling and bolting machine capable of precisely moving a drilling assembly longitudinally and transversely to permit the drilling of bolt holes and the installation of roof bolts in a mine roof at preselected locations.

Another object of the present invention is to provide a mobile roof bolt installation machine that effects rapid drilling and spacing of roof bolt holes for the installation of roof bolts in a mine roof in accordance with a preselected pattern.

Another object of the present invention is to provide a roof bolting machine having a protective canopy under which the operator is positioned at all times and from which the operator may control the longitudinal and transverse movement of the drill unit to precisely locate and drill in a mine roof bolt holes and install roof bolts therein.

A further object of the present invention is to provide a roof drilling and bolting machine having fluid actuated roof and ground engaging jacks that are positioned between the machine operator and the mine face and are operable to stabilize the machine frame and to provide roof support during the drilling of the bolt holes and installation of the roof bolts.

A still further object of the present invention is to provide a mobile drilling and bolting machine having a pair of spaced apart drill units that are supported by a carriage that is arranged for transverse movement on a horizontal frame portion for precisely positioning the drill units to drill holes and install roof bolts at preselected locations in the mine roof.

These and other objects and advantages of this invention will be more completely described and disclosed in the following specification, the accompanying drawings and the appended claims.

DESCRIPTION OF THE PREFERRED EMBODIMENTS

Figure 1:
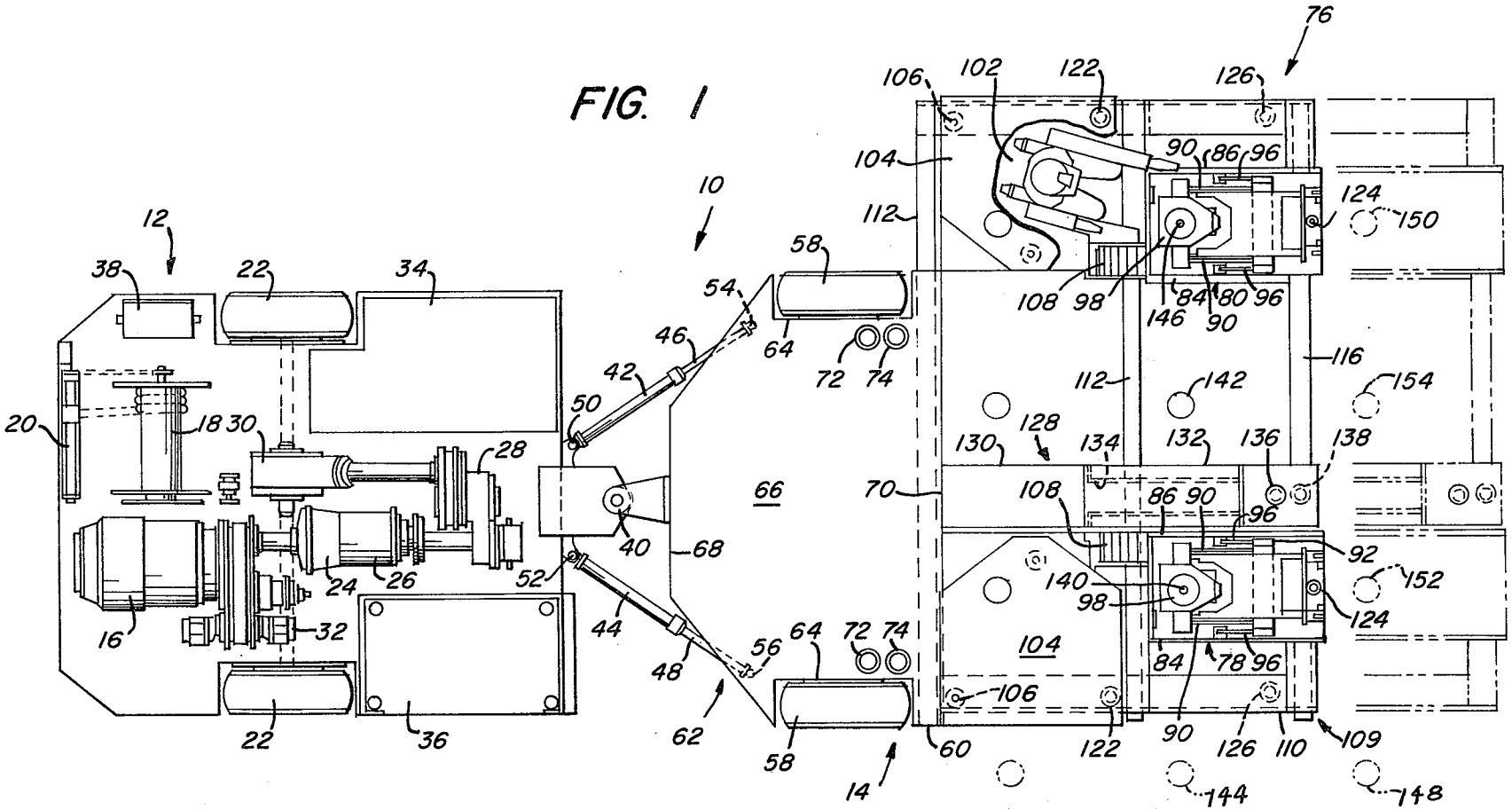
FIG. 1 is a top plan view of a mobile drilling and bolting machine, illustrating the drill units in laterally extended and retracted position and in phantom in longitudinally extended position.
Figure 2:
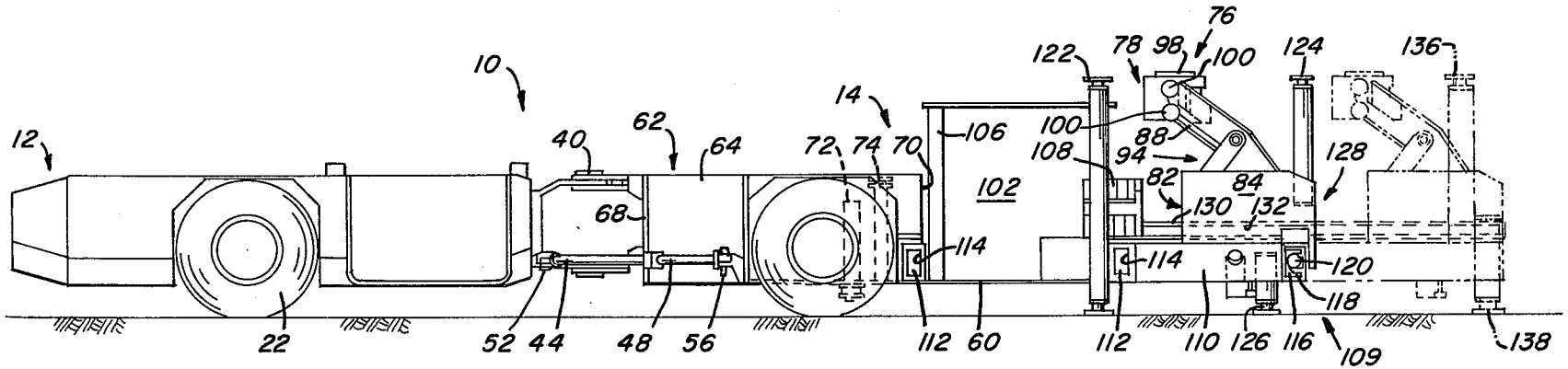
FIG. 2 is a side elevation of the mobile drilling and bolting machine of FIG. 1, illustrating in phantom the drill units in longitudinally extended position.

Referring to FIGS. 1 and 2, there is illustrated a mobile drilling and bolting machine generally designated by the numeral 10 that includes a prime mover portion 12 operably connected to a mobile body portion 14.

The prime mover 12 generally comprises a power and control station for the machine 10 and has mounted thereon a main power source, such as an electric motor 16. Electrical power is supplied to motor 16 through an electrical cable wound upon a cable reel 18 through a spooling device 20. The motor 16 is operably connected to drive wheels 22 of prime mover 12.

As illustrated in FIG. 1, the motor 16 is connected to drive wheels 22 through a gear reducer 24 and clutch 26 that is connected to an input shaft of a transmission 28. The transmission 28 is operably connected to a differential 30 through a suitable drive shaft. The differential 30 has output shafts connected to the driving axles upon which the wheels 22 are mounted. The motor 16 is also employed for operating a fluid pump 32 that supplies fluid under pressure to the various fluid actuated piston cylinder assemblies and jacks provided on the mobile body portion 14. The fluid pump 32 supplies fluid, such as hydraulic oil, from a tank 34 located on the prime mover 12 to the various fluid operated devices hereinafter described. Suitable fluid valves and controls therefor for supplying fluid at desired pressure to the selected cylinderrs are provided on the prime mover 12 at a control station 36 which includes both electrical controls and hydraulic controls. Located at the side of the prime mover 12 opposite from the motor 16 is an electric control apparatus 38 comprising switches and controls by which the speed and direction of operation of the motor 16 is regulated.

The prime mover 12 is operably connected to the mobile body portion 14 in a fashion that permits the machine 10 to be driven and steered. As illustrated in FIGS. 1 and 2, the prime mover 12 is pivotally connected to the mobile body portion 14 through a pivot connection 40. A pair of cylinders 42 and 44 are provided for rotating the prime mover 12 about the pivot connection 40 so that the mobile drilling machine may be steered. Each of the cylinders 42 and 44 includes rods 46 and 48 extending between the prime mover 12 and the mobile body portion 14. Each cylinder and rod is pivotally connected to both the mobile body portion and the prime mover. Pivot pins 50 and 52 connect the cylinders 42 and 44 respectively, to the prime mover 12. The rods 46 and 48 are pivotally connected to the mobile body portion 14 by pivot pins 54 and 56, respectively. Each of the cylinders 42 and 44 is preferably a fluid actuated piston cylinder assembly and functions as a steering cylinder by which actuation of the cylinder 42 extends the rod 46 to permit the mobile body portion 14 to be steered to the left. Conversely, actuation of the cylinder 44 to extend the rod 48 permits the mobile body portion 14 to be steered to the right.

The mobile body portion 14, like the prime mover 12, is a wheeled vehicle, such as a trailer, and includes wheels 58. The mobile body portion or trailer 14 has a longitudinally extending horizontal frame 60 that includes a fixed storage hopper 62 mounted thereon. The storage hopper 62 comprises parallel spaced, vertically extending sidewalls 64 that are supported by a bottom plate 66. The storage hopper is enclosed by front and rear walls 68 and 70 respectively, which are also supported by the bottom plate 66 that forms the floor of the storage hopper. With this arrangement, the hopper 62 functions as a convenient storage area for equipment, such as drill rods, their mountings, roof bolts, roof plates and the like, which are utilized in the roof drilling and roof bolting operations.

Pairs of stabilizing jacks 72 and 74 are mounted on opposed sides of the storage hopper 62. The pair of stabilizing jacks 72 may be actuated either mechanically or hydraulically to forcefully engage the floor of the mine and therby rigidly position the trailer 14. In cooperation with the pair of stabilizing jacks 72, roof jacks 74 operable in a manner similar to the jacks 72 are arranged to engage the mine roof to support the mine roof and further stabilize the trailer 14 during the drilling operations.

A drilling assembly generally designated by the numeral 76 is positioned forwardly of the storage hopper 62 on the horizontal frame 60 and is arranged to move transversely thereon in a manner hereinafter described. The drilling assembly 76 may comprise a suitable number of drill pods for performing the drilling and bolting operations. In the specific embodiment illustrated in FIG. 1, a pair of spaced apart drill pods 78 and 80 are positioned for transverse movement on the horizontal frame 60. Each of the drill pods 78 and 80 is mounted on a support frame 82 having parallel spaced side plates 84 and 86. The support frame 82 is also movable transversely relative to the horizontal frame 60.

The support frame 82 carries a boom 88 mounted to move vertically in a linear path. The boom 88 consists of a pair of side rails 90 maintained in parallel spaced relationship by an interconnecting web 92 at the base of the boom. The boom 88 is carried by an elevating link 94 that is pivotally mounted to the side plates 84 and 86 of support frame 82. The elevating link 94 is composed of a pair of parallel arms 96 that are pivotally connected at one end to the support frame side plates 84 and 86 and at the other end to the interconnecting web 92 which supports the boom rails 90.

Each of the drill pods 78 and 80 comprises a drill unit 98 that is pivotally connected to the boom side rails 90 by trunnions 100 that project outwardly from the side rails 90. The drill unit 98 includes a conventional drill steel that is rotatably mounted in a chuck. A hydraulic motor is connected to the drill unit 98 and rotates the drill steel. The drill unit 98 is also adaptable to install the roof bolts in the drilled hole by inserting the roof bolt in the drill chuck. Rotation of the hydraulic motor advances the roof bolt into the drilled hole. A hydraulic jack (not shown) is pivotally connected to the arms of the elevating link 94 and, upon actuation, raises and lowers the elevating link 94 to thus raise and lower the boom 88 and drill unit 98 in a vertical linear path.

An operator's station 102 is positioned to the rear of each of the drill pods 78 and 80 and forward of the trailer 14 on the horizontal frame 60. The operator's station 102 is provided with an overhead canopy 104 that is supported at suitable elevation above the frame 60 by vertical posts 106. With this arrangement, the operator is protected at all times during the roof drilling and roof bolting operations from the hazards of falling debris dislodged from the mine roof. Furthermore, the proximity of the operator's station 102 to the drill unit 98 permits the operator to remain under the protection of the canopy 104 while he maneuvers and operates the drill unit 78.

The operation and control of the drill units 98 and the various fluid actuated devices provided on the trailer 14 are accomplished through suitable controls located at control panel 108. The control panel 108 is positioned adjacent the operator's station 102 to conveniently provide the operator with access to the various controls under the protection of the overhead canopy 104. The controls on the control panel 108 may include both electrical and hydraulic controls for actuating the various piston cylinder assemblies and electric motors utilized in the roof drilling and roof bolting operations.

The drill pods 78 and 80 may be individually operated; however, it is preferred that only one of the control panels 108 include provisions for tramming and steering the trailer 14. Accordingly, the machine operator may remain under the protective canopy 104 and through the control panel 108, raise and lower the drill boom 88 to install a drill bit in the drill unit 98 and raise the drill unit to a position adjacent the mine roof. Through additional control devices, the drill unit 98 is operable to drill bolt holes and install roof bolts in the mine roof without the machine operator being required to leave the operator's station 102.

The drill pods 78 and 80 are laterally movable on the horizontal frame 60 through a guide mechanism generally designated by the numeral 109 to thus permit the drilling of bolt holes in the mine roof along a line transverse to the longitudinal axis of the trailer 14 and spaced a preselected distance apart. The guide mechanism 109 includes a carriage 110 that movably supports the drill pods 78 and 80 together with the operator's stations therefor. A plurality of parallel spaced longitudinal beam members 112 are rigidly connected to and extend transversely of the horizontal frame 60. The carriage 110 is proviided with longitudinal channels 114 that slidably receive the beam members 112. With this arrangement, the carriage 110 is mounted for slidable movement on beam members 112.

A beam member 116 is positioned parallel to beam members 112 and is rigidly connected to the front end portion of the horizontal platform 60. The beam member 116 is slidably received within longitudinal recess 118 of the carriage 110. A fluid actuated device 120, such as a hydraulic piston cylinder assembly, is mounted on the horizontal platform 60 and is connected at one end to the carriage 110 within the recess 118 and at the other end to the beam member 116. Actuation of the piston cylinder assembly 120 moves the carriage 110 together with the drill pods transversely on the beam members 112 and 116. Thus, each carriage 110 of the drill pods 78 and 80 is reciprocally movable to a preselected location on the transverse beams 114 and 116 by remotely actuating the piston cylinder assembly 120 at the control panel 108 provided in each operator's station 102.

To immovably secure the trailer 14 and to provide additional roof support during the drilling and bolting operations, a plurality of power actuated hydraulic jacks are provided on the drill assembly 76. Double acting safety jacks 122 are positioned at the operator's stations 102 and are operable upon actuation of a conventional hydraulic piston cylinder assembly to engage the mine roof and floor during the drilling operation. The piston cylinder assembly for actuating each of the safety jacks 122 is controlled at the control panel 108 by a suitable valve which supplies fluid through a hydraulic line to the actuating cylinder. In a similar arrangement, fluid actuated jacks 124 and 126 are mounted on the drill assembly 76. These jacks are controlled by a selected lever at the control panel 108 and are operable to engage the mine roof and floor to rigidly secure the trailer 14 and support the mine roof during the drilling operation.

In addition to the above described arrangement for positioning the drill pods 78 and 80 to drill bolt holes and install roof bolts in the mine roof, the drill pods 78 and 80 may be forwardly advanced in a direction parallel to the longitudinal axis of the trailer 14 a predetermined distance for the drilling of a subsequent row of transverse bolt holes without requiring the forward tramming of the trailer 14 by the prime mover 12. To effect forward advancement of the drilling assembly 76 a preselected distance, an extensible mechanism, generally designated by the numeral 128 is provided on the horizontal platform 60. The extensible mechanism includes a first telescoping member 130 that is rigidly secured to the front wall 70 of the trailer 14 and extends forwardly therefrom along a line parallel to the longitudinal axis of the trailer 14. A second telescoping member 132, having a channel 134, is positioned for reciprocal movement on the telescoping member 130. With this arrangement, the telescoping member 132 is adapted to move reciprocally and longitudinally of trailer 14.

Operation of the extensible mechanism 128 is accomplished through a fluid actuated piston cylinder assembly (not shown). The cylinder portion of the assembly may be rigidly connected in a conventional manner to the telescoping member 130 that is rigidly secured to the trailer front wall 70, and the piston rod of the assembly is suitably connected to the movable telescoping member 132. With this arrangement, actuation of the piston cylinder assembly through a control on one of the control panels 108 supplies fluid under pressure to the piston cylinder to thereby extend the piston rod and thus longitudinally move the telescoping member 132 a preselected distance, as illustrated by the dotted lines in FIGS. 1 and 2. As determined by the fluid pressure in the piston cylinder assembly, the piston rod is extended from the cylinder and the telescoping member 132 moves longitudinally relative to the telescoping member 130. After the telescoping member 132 has been advanced longitudinally in a forward direction a preselected distance. Fluid actuated jacks 136 and 138 are actuated to engage the mine roof and floor to rigidly secure the telescoping member 132. By operation of the appropriate lever on the selected control panel 108, the piston rod of the extensible mechanism 128 is retracted into the cylinder. Retraction of the piston rod into the cylinder with the telescoping member 132 rigidly secured by operation of the jacks 136 and 138 imparts forward movement to the telescoping member 130. The telescoping member 130 advances into the telescoping member 132. The forward movement of the telescoping member 130 is transmitted to the trailer 14 and the prime mover 12 to forwardly move the mobile drilling machine 10. In this manner, the drilling assembly 76 is positioned at a new location for drilling a subsequent row of transverse bolt holes a preselected distance forward of the previously drilled transverse row of bolt holes. By advancing the mobile drilling machine in this fashion, the machine operator is not required to forwardly tram the mobile drilling machine 10 a preselected distance in order to selectively position the drilling assembly 76 at a predetermined location for drilling further bolt holes and installation of roof bolts therein.

In operation, the mobile drilling machine 10 is propelled by the prime mover 12 through operation of the electric motor 16 to the desired location in the mine for commencement of the drilling and bolting operations. With the drilling machine 10 in position for drilling, the stabilizing jacks 72 and the roof jacks 74 provided on trailer 14 are actuated to engage the floor and roof of the mine to thereby stabilize the trailer 14 and provide roof support during the drilling operation. In addition, the power actuated jacks 122, 124, 126, 136 and 138 are operated to engage the mine roof and floor and thereby rigidly brace the drilling assembly 76 and provide further roof support.

The drill pods 78 and 80 of drilling assembly 76 are initially retracted on the beam members 112 and 116 to a position where the lateral end portions of the protective canopy 104 are aligned with the wheels 58 of the trailer 14. A drill steel is inserted in each of the drill units 98 and the lifting jacks associated with the elevating links 94 are actuated to raise the elevating links and thereby lift the booms 88 and raise the drill units 98 into position adjacent the mine roof. When the drilling is completed, the operators through the control panels 108 lower the booms 88 and drill units 98 through the elevating links 94 to replace the drill steels in the drill units with the roof bolt assemblies. The booms are once again raised and the roof bolts installed in the drilled holes 140 and 142. When the bolting operation is complete, drilling units 98 are lowered free of the mine roof and the piston cylinder assembly 120 of the guide mechanism 109 is actuated to laterally extend the drill pods 78 and 80 by movement of the carriage 110 on the beam members 112 and 116. In this manner, the drill pods 78 and 80 are moved a predetermined distance from their previous location to a second location for drilling holes and installing bolts in the mine roof along a line transverse to the longitudinal axis of the trailer 14. In a specific embodiment through operation of the appropriate valve on the control panel 108 that actuates the piston cylinder assembly 120, the drill pods 78 and 80 may be moved to provide a distance of precisely four feet between adjacent bolt holes for the installation of roof bolts on four foot centers. When the outermost bolt holes 144 and 146 have been drilled and the bolts installed, the booms 88 are lowered and the jacks 136 and 138 on the extensible mechanism 128 are released to permit forward advancement of the drilling assembly 76.

The piston cylinder assembly of the extensible mechanism 128 is actuated to longitudinally move the telescoping member 132 forwardly a preselected distance. Thereafter, the jacks 136 and 138 are actuated to engage the mine roof and floor and thereby rigidly brace the telescoping member 132. Jacks 72, 74, 122, 124 and 126 are then released from engagement with the mine roof and floor. The piston cylinder assembly within the extensible mechanism 128 is retracted remotely by a suitable valve on the control panel 108. Retraction of the piston rod into the cylinder forwardly advances the extensible member 130 into the telescoping member 132. Simultaneously, the trailer 14 and the prime mover 12 are forwardly advanced a predetermined distance to thereby position the drilling assembly 76 for drilling another transverse row of bolt holes parallel to the previously drilled transverse row of bolt holes.

Prior to commencing the drilling operation, the jacks 72, 74, 122, 124 and 126 are once again actuated to rigidly brace the trailer 14 and support the mine roof. The drill pods 78 and 80 remain in the laterally extended position on the transverse beam members 112 and 116 so that holes 148 and 150 may be drilled in the mine roof and aligned with the bolt holes 144 and 146 of the previous row. The drilling and bolting is accomplished in the above described manner and when the operation is completed, the booms 88 are lowered and the jacks 122, 124 and 126 retracted. The carriage 110 is then laterally retracted on the transverse beam members 112 and 116 to thereby position the drill pods 78 and 80 for drilling holes 150 and 152 aligned with the bolt holes 140 and 142 of the previous transverse row.

By laterally moving the drill pods 78 and 80 on the transverse beam members 112 and 116 and by forwardly advancing the entire drilling assembly 76, by operation of the extensible mechanism 128, the drill units 98 are precisely positioned at preselected locations to quickly and efficiently drill holes in the mine roof for installation of roof bolts. Furthermore, during the entire drilling operation, the operators remain under the protection of the overhead canopies 104. Thus the entire drilling and bolting operation is remotely controlled from the protected operator's stations 102.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. A mobile drilling and bolting machine comprising,
a mobile body portion having a frame portion,
means for propelling said mobile body portion, said propelling means pivotally connected to said mobile body portion,
a drilling assembly positioned for vertical movement on said mobile body portion,
extensible means connected to said mobile body portion and extending forwardly thereof for forwardly advancing a preselected distance said mobile body portion and said drilling assembly,
said extensible means including a telescoping member having a first end portion secured to said mobile body portion and a second end portion movably connected to said first end portion such that said second end portion is extensible relative to said first end portion,
means provided on said telescoping member second end portion for fixedly positioning said second end portion in an extended position such that retraction of said first end portion into said fixed second end portion forwardly advances said mobile body portion and said drilling assembly,
guide means movably positioned on said frame portion for supporting said drilling assembly for transverse movement on said mobile body portion, and
actuating means connecting said guide means to said frame portion for transversely moving said guide means together with said drilling assembly to a preselected position on said mobile body portion.

2. A mobile drilling and bolting machine as set forth in claim 1 which includes,
said guide means being forwardly movable with said frame portion.

3. A mobile drilling and bolting machine as set forth in claim 1 which includes,
power actuated roof and ground engaging jack members connected to said drilling assembly for immovably positioning said mobile body portion and said drilling assembly.

4. A mobile drilling and bolting machine as set forth in claim 1 which said extensible means includes,
said telescoping member extending forwardly of said mobile body portion parallel to the longitudinal axis thereof,
said telescoping member second end portion slidably connected to said first end portion to extend longitudinally a preselected distance relative to said mobile body portion to a position for subsequent drilling by said drilling assembly, and
roof and ground engaging means for immovably positioning said second end portion, said roof and ground engaging means supported by said mobile body portion.

5. A mobile drilling and bolting machine as set forth in claim 1 in which said means for fixedly positioning said telescoping member second end portion includes,
a pair of jack members secured to said telescoping member second end portion,
power actuated means for vertically extending said jack members to engage the mine roof and floor, said power actuated means operable to rigidly secure said telescoping member second end portion relative to said first end portion such that retraction of said telescoping member first end portion into said telescoping member second end portion when in an extended position longitudinally advances said mobile body portion and thereby forwardly moves said drilling assembly to a preselected location.

6. A mobile drilling and bolting machine as set forth in claim 1 which includes,
power actuated roof and ground engaging jack members provided on said frame portion for immovably positioning said frame portion as said telescoping member second end portion extends relative to said telescoping member first end portion.

7. A mobile drilling and bolting machine as set forth in claim 1 in which said drilling assembly includes,
a pair of drill pods positioned in spaced relationship on said guide means,
said drill pods each supporting a drill unit for movement in a vertical linear path,
said drill pods transversely movable with said guide means on said mobile body portion, and
power actuated roof and ground engaging means provided on said drill pods for immovably positioning said drill pods during the drilling operation.

8. A mobile drilling machine as set forth in claim 1 which said guide means includes,
a plurality of parallel spaced transversely extending beam members rigidly mounted on said frame portion, and
a carriage supporting said drilling assembly, said carriage mounted for reciprocal transverse movement on said beam members to transversely move said drilling assembly to a preselected location on said frame portion for vertical drilling.

9. A mobile drilling machine as set forth in claim 1 in which said actuating means includes,
a fluid actuated piston cylinder assembly operable to extend and retract and thereby transversely move said drilling assembly to a preselected location on said frame portion.

10. A mobile drilling machine as set forth in claim 1 which includes, said drilling assembly having an operator's station covered by an overhead protective canopy, power actuated roof engaging jack members provided on said protective canopy and arranged to contact and support a mine roof during the drilling and bolting operations, and power actuated ground engaging jack members provided on said frame portion and arranged to contact a mine roof to immovably position said mobile body portion during the drilling and bolting operations.

* * * * *